US007125833B2

(12) United States Patent
Schmid et al.

(10) Patent No.: US 7,125,833 B2
(45) Date of Patent: Oct. 24, 2006

(54) CYCLODEXTRIN LAUNDRY DETERGENT ADDITIVE COMPLEXES AND COMPOSITIONS CONTAINING SAME

(75) Inventors: Gerhard Schmid, Ann Arbor, MI (US); Mark Harrison, Ann Arbor, MI (US); Patrick Polchinski, Tecumseh, MI (US)

(73) Assignee: Wacker Chemie AG, Munich (DE)

( * ) Notice: Subject to any disclaimer, the term of this patent is extended or adjusted under 35 U.S.C. 154(b) by 212 days.

(21) Appl. No.: 10/396,807

(22) Filed: Mar. 24, 2003

(65) Prior Publication Data

US 2004/0192576 A1 Sep. 30, 2004

(51) Int. Cl.
*C11D 3/22* (2006.01)

(52) U.S. Cl. ..... 510/470

(58) Field of Classification Search ..... 510/470
See application file for complete search history.

(56) References Cited

U.S. PATENT DOCUMENTS

| | | | | |
|---|---|---|---|---|
| 1,947,725 | A | 2/1934 | Macarthur | |
| 3,933,672 | A | 1/1976 | Bartolotta et al. | |
| 3,933,673 | A | 1/1976 | Davies | |
| 3,985,669 | A | 10/1976 | Krummel et al. | |
| 4,072,621 | A | 2/1978 | Rose | |
| 4,116,852 | A | 9/1978 | Bailey et al. | |
| 4,152,515 | A | 5/1979 | Lamberti et al. | |
| 4,247,592 | A | 1/1981 | Kalinowski | |
| 4,265,779 | A | 5/1981 | Gandolfo et al. | |
| 4,308,158 | A | 12/1981 | Gohla et al. | |
| 4,477,371 | A | 10/1984 | Huber et al. | |
| 4,507,455 | A | 3/1985 | Tangney et al. | |
| 4,605,509 | A | 8/1986 | Corkill et al. | |
| 4,613,448 | A | 9/1986 | Cheng | |
| 4,659,497 | A | 4/1987 | Akred et al. | |
| 4,663,071 | A | 5/1987 | Bush et al. | |
| 4,680,134 | A | 7/1987 | Heile et al. | |
| 4,686,060 | A | 8/1987 | Crabtree et al. | |
| 4,728,510 | A | 3/1988 | Shibanai et al. | |
| 4,732,759 | A | 3/1988 | Shibanai et al. | |
| 4,775,749 | A | 10/1988 | Hijiya et al. | |
| 4,777,162 | A | 10/1988 | Hijiya et al. | |
| 4,831,022 | A | 5/1989 | Hijiya et al. | |
| 4,906,397 | A | 3/1990 | Leighton et al. | |
| 4,919,843 | A | 4/1990 | Innertsberger et al. | |
| 4,978,363 | A | 12/1990 | Ona et al. | |
| 4,978,561 | A | 12/1990 | Cray et al. | |
| 5,019,282 | A | 5/1991 | Farng et al. | |
| 5,019,292 | A | 5/1991 | Baeck et al. | |
| 5,032,662 | A | 7/1991 | Berger et al. | |
| 5,061,396 | A | 10/1991 | Lovine et al. | |
| 5,100,991 | A | 3/1992 | Cray et al. | |
| 5,139,687 | A * | 8/1992 | Borgher et al. | 510/515 |
| 5,189,149 | A | 2/1993 | Bruzzese et al. | |
| 5,238,596 | A | 8/1993 | Smith | |
| 5,378,388 | A | 1/1995 | Pancheri | |
| 5,380,464 | A | 1/1995 | McGee et al. | |
| 5,384,186 | A | 1/1995 | Trinh | |
| 5,540,952 | A | 7/1996 | Canivenc et al. | |
| 5,625,024 | A | 4/1997 | Schlitte et al. | |
| 5,635,238 | A | 6/1997 | Trinh et al. | |
| 5,643,862 | A | 7/1997 | Jones et al. | |
| 5,648,327 | A | 7/1997 | Smerznak et al. | |
| 5,905,067 | A * | 5/1999 | Chapman et al. | 510/368 |
| 6,114,299 | A | 9/2000 | Hunter et al. | |
| 6,187,891 | B1 | 2/2001 | Rautschek et al. | |
| 6,287,603 | B1 | 9/2001 | Prasad et al. | |
| 6,432,928 | B1 | 8/2002 | Szente et al. | |
| 6,503,413 | B1 * | 1/2003 | Uchiyama et al. | 252/8.91 |
| 6,503,879 | B1 | 1/2003 | Lentsch et al. | |
| 2002/0007055 | A1 | 1/2002 | Uchiyama et al. | |
| 2002/0010154 | A1 | 1/2002 | Uchiyama et al. | |
| 2002/0193273 | A1 | 12/2002 | Richards, III et al. | |
| 2004/0176265 | A1 * | 9/2004 | Milius et al. | 510/470 |

FOREIGN PATENT DOCUMENTS

| | | |
|---|---|---|
| DE | 4 035 378 | 7/1977 |
| DE | 4140830 | * 6/1992 |
| EP | A 0 040 562 | 11/1981 |
| EP | A 0 238 910 | 10/1987 |
| EP | 0 663 225 | 7/1995 |
| EP | 0 859 047 | 8/1998 |
| EP | 1127940 | 8/2001 |
| WO | WO 02/100524 | * 12/2002 |

OTHER PUBLICATIONS

J. E. Gray et al., Australian Journal of Chemistry, 1995, vol. 48, pp. 551-556, Dec. 1995.*
E. Junquera et al., Journal of Colloid and Interface Science, 1994, vol. 163, pp. 355-361, Dec. 1994.*
E. Junquera et al., Journal of Physical Chemistry 1992, vol. 96, pp. 4533-4537, Dec. 1992.*
Abstract in English corr. to DE 4 035 378.
Abstract in English corr. to EP 1127940.
Abstract in English corr. to EP0 040 562

* cited by examiner

*Primary Examiner*—John R. Hardee
(74) *Attorney, Agent, or Firm*—Brooks Kushman P.C.

(57) ABSTRACT

Cyclodextrin inclusion complexes of hydrophobic actives are useful in liquid and solid laundry detergent formulations. The inclusion complexes are stable and capable of releasing their active ingredients gradually during wash and rinse cycles.

1 Claim, No Drawings

CYCLODEXTRIN LAUNDRY DETERGENT ADDITIVE COMPLEXES AND COMPOSITIONS CONTAINING SAME

BACKGROUND OF THE INVENTION

1. Field of the Invention

The present invention is directed to the field of textile laundering, to cyclodextrin compositions containing textile laundering additives for use therein, and to processes for producing these compositions.

2. Background Art

Textiles are subjected to laundering during several stages in their life cycles. For example, textiles may be laundered after weaving to remove traces of spin finishes and/or lubricants applied during yarn preparation or prior to weaving, to remove soil accumulated during the weaving process, to remove fugitive dyes, etc. Textiles may also be laundered prior to fabrication into articles such as white goods, clothing, etc., or following fabrication, to impart fabric finishes such as softeners, antistats, or brighteners, to modify the appearance, e.g. stone washing, partial bleaching, etc. The term "laundering" and like terms as used herein apply to all these activities and to others whereby textiles are contacted with aqueous detergent-containing compositions to alter their properties.

Many laundering compositions have been developed for the above uses, the vast majority in relatively concentrated form, which are diluted upon use to form an aqueous working composition of the desired strength. Non-limiting examples of such compositions include liquid and dry laundry detergents, fabric softeners, bleaches, particularly non-chlorinated bleaches, rinse aids, optical brigheners, etc. Frequently, compositions are marketed which perform several of the functions of the compositions identified above in a single composition. Thus, laundry detergents frequently include oxygen bleaches, optical brighteners, fabric softeners, antistatic agents, and UV absorbing materials. Incorporation of these components into a single composition is particularly important for the ultimate consumer, who is not likely to wish to add a variety of different products to a wash load, particularly at different times in the wash cycle.

Typical laundering processes, whether domestic or industrial, require several cycles, e.g. one or more treatment cycles followed by one or more rinse cycles. In many cases, it is necessary that a desired active component be effective over several or all of these cycles, and at times, to be highly effective during the latter of the cycles. In the case of antifoams, for example, it is desirable that these retain their efficiency during the wash cycles and also desirably at least the first rinse cycle.

The majority of components of laundry compositions are water soluble. These include, for example, the detergents, whether ionic, nonionic, or zwitterionic, the builders and sequestrants, alkalizers, salts, etc. Other ingredients such as antifoams, softeners, rinse aids, and optical brighteners may be only partially soluble or insoluble. Still other active ingredients may be soluble, but it is desired that are released and deposit on the textiles later in the wash process so that the deposits remain on the textile even after the rinse cycle is complete. The active ingredients must also be storage stable in their respective compositions, i.e., concentrates such as granulated or liquid laundry detergents. However, many detergent actives do not exhibit such stability.

In the case of antifoams, for example, simple silicone oils are known as effective antifoam agents. However, their antifoam activity diminishes rapidly during even a first wash cycle, and hence quite complex formulations including silicone oils, silicone resins, and other additives, frequently adsorbed or absorbed onto or into porous supports such as fumed or precipitated silica have been developed. Even so, many of these compositions are not storage stable in some compositions, particularly liquid detergents, and thus special formulations have been developed for these products. In the case of softeners, brighteners, antistats and the like, which must remain on the laundered fabric, it is desirable that these ingredients are efficiently deposited and remain adherent, as components which exit during the wash or rinse cycles represent a loss of active ingredient which then requires an increased amount in the composition to be effective for their intended purpose.

Cyclodextrins are cyclic molecules of linked saccharides. The most common cyclodextrins ("CDs") are α-CD, β-CD, and γ-CD, containing 6, 7, and 8 D-glucopyranosyl moieties, respectively. These cyclodextrins have limited water solubility, β-CD having a water solubility of only about 18 g/L, while α-CD and γ-CD have somewhat higher solubilities, 145 and 232 g/L, respectively. Cyclodextrins may be modified, to produce alkyl-, hydroxyalkyl-, ester- and other modified CDs. CDs have a relatively hydrophobic guest cavity and a hydrophilic exterior, and have been used, e.g. to form inclusion complexes of odiferous and/or easily oxidizable polyunsaturated oils, as in U.S. Pat. Nos. 4,775,749; 4,777,162; 4,831,022; and 5,189,149. The odor of such products is reduced considerably and their oxidative stability enhanced. Inclusion of flavor oils, for somewhat the same reasons, is disclosed in U.S. Pat. No. 6,287,603. The foregoing products are, in general, used in powder form.

CDs have also been shown to be useful in supplying relatively water-insoluble drug candidates at higher concentrations than the aqueous solubilities of the dry actives, as disclosed in U.S. Pat. No. 6,432,928, wherein CDs whose water solubility has been increased by modification are used to complex the poorly soluble pharmaceutical actives.

The ability to form inclusion complexes is necessarily limited to molecules which can enter the hydrophobic cavity. Furthermore, the usefulness of CD inclusion complexes is unpredictable when the chemistry of the surroundings is complex. For example, inclusion complexes of ω-3 fatty acids, when dispersed in oily vehicles, can exhibit guest/solvent interchange, and thus the benefits of including the ω-3 fatty acid in the CD complex are largely lost.

CDs have seen only limited use in laundering compositions. For example, in DE 4 035 378, fabrics are treated with cyclodextrins which are then linked to the fabric by use of traditional cellulose-reactive crosslinkers. The fabric, now bearing cyclodextrin groups on its surface, is rendered odor-resistant, the cyclodextrins absorbing odiferous molecules during wearing by the user. Athletic socks with the aforementioned bonded cyclodextrin having experienced some commercial success.

In EP 1127940, detergents useful for washing textiles to produce a textile product with soft hand are disclosed. The soft hand is said to be imparted by interaction of the CD with the fabric. In addition to the CD, the formulations contain a long chain aliphatic carboxylic acid, and a cationic surfactant. However, no CD inclusion complexes are disclosed. Because of the high loadings of powerful surfactants, alkali, builders, sequestrants and the like, it would not be expected that CD inclusion complexes would be useful in laundering compositions. This is especially the case when the composition also contains quantities of hydrophobic substances, which would be expected to exchange with the guest of a CD guest/host inclusion complex.

SUMMARY OF THE INVENTION

It has now been surprisingly discovered that hydrophobic actives useful in laundering compositions can be supplied as cyclodextrin inclusion complexes. Despite the complex environment in the compositions in which they are used, the complexes are stable, and exhibit effects which persist through multiple cycles, effects which are not achievable merely by adding cyclodextrins to an existing laundry formulation.

DETAILED DESCRIPTION OF THE PREFERRED EMBODIMENTS

The compositions to which the present invention is directed include all compositions, whether liquid or solid, which are used in aqueous laundering applications. Such compositions include numerous active ingredients, each of which contributes to the composition, for example in terms of wash/rinse effectiveness, ability to formulate in an acceptable manner, and storage stability.

Typical laundry detergent formulations, both liquid and solid, are disclosed in numerous patents and publications, and are well known to those skilled in the art. Solid formulations include powders, prills, and compressed "brick" formulations, either prepared by compression or by fusing the detergent ingredients, as taught by U.S. Pat. No. 4,680,134. Liquid detergent formulations are disclosed, for example, in U.S. Pat. No. 4,659,497, herein incorporated by reference, while solid granular formulations are disclosed in U.S. Pat. Nos. 4,116,852; 4,663,071; and 5,019,282, also herein incorporated by reference.

Both nonionic and ionic detergents or "tensides" are useful in detergent formulations. Since low foaming laundry compositions are desirable, the selection of detergents is mainly directed to low foaming types. If higher foaming detergents are used, correspondingly greater amounts of defoamers will ordinarily be required.

Nonionic detergents include polyoxyalkylated active hydrogen-containing hydrophobes such as polyoxyalkylated fatty acids, fatty alcohols, and fatty amines, as well as polyoxyalkylated aromatic hydrophobes such as alkylphenols, i.e. nonylphenol. Oxyalkylation may be performed with ethylene oxide or mixtures of ethylene oxide and a higher alkylene oxide such as propylene oxide or butylene oxide. Ethylene oxide alone or mixtures of ethylene oxide and propylene oxide, either distributed randomly or in block form, are preferred. Further suitable nonionic surfactants are those where a hydrophobe consists of a polyoxypropylene block, generally having a molecular weight greater than 500, and a hydrophile consisting of a polyoxyethylene block. Such surfactants are available from BASF Corporation under the tradenames PLURONIC® and TETRONIC® surfactants.

Nonionic surfactants such as the above may be converted to anionic or cationic surfactants by modifying to contain ionic groups such as sulfonate, sulfate, phosphonate, or phosphate groups, or ammonium groups. Non-polyether surfactants which are ionic include alkyl, aryl, and alkaryl sulfonates, phosphates phosphonates, and sulfates, such as sodium dodecylbeizene sulfonate, ammonium dodecyltoluene sulfonate, and laurylbenzyl dimethyl ammonium chloride. Examples of nonionic and ionic surfactants are disclosed in U.S. Pat. No. 4,613,448 and other patents cited herein.

Builders are detergency increasing substances which are particularly effective in applications when water hardness is to be expected. Many builders have been used, including alkali metal phosphates, which also may serve as alkalizing agents, and alkali metal polycarboxylates, etc. Numerous builders are disclosed in U.S. Pat. Nos. 3,933,673; 4,072,621; 4,116,852; 4,613,448; 4,152,515; 4,906,397; 5,061,396; 4,663,071; 5,378,388; 4,308,158; and 4,605,509, all herein incorporated by reference.

Detergent compositions also frequently contain sequestrants which serve to chelate metal ions, particularly those associated with water hardness, i.e. magnesium, calcium, and iron. Suitable sequestrants are known to the art. Examples are disclosed in U.S. Pat. Nos. 3,985,669 and 6,503,879, herein incorporated by reference, and in other patents cited previously.

Fabric softeners are of numerous types. These softeners act through that presence on the fabric to impart a pleasant "hand" or soft feel. Fabric softeners generally consist of a relatively hydrophobic component and a polar component which assists in adherence to the fabric during washing, rinsing, or pre-manufacture or post-manufacture of textile goods. Examples of the latter include denim fabrics, where in addition to softness, prevention of yellowing of the indigo dyes used in dyeing the fabric is also important.

U.S. Pat. No. 6,114,299 discloses softeners containing nitrogen-functional polysiloxanes and polyisobutylene oligomers. U.S. Pat. No. 4,247,592 discloses aminoalkylpolyorganosiloxanes as softeners, whereas U.S. Pat. No. 4,978,363 discloses that fatty acid salts of aminoalkylorganopolysiloxanes exhibit an improvement of yellowing. U.S. Pat. No. 5,540,952 discloses piperidinyl- and morpholinyl-substituted organopolysiloxanes. U.S. Pat. No. 4,507,455 discloses acylated organopolysiloxanes containing pendant amino functionality, whereas U.S. Pat. Nos. 4,978,561 and 5,100,991 disclose similar products wherein acylation with lactones produces N-(hydroxyalkyl)acylated products. Published U.S. application No. US-2002-0193273 A1 discloses N-acylated, $\alpha,\omega$-aminoalkyl-functional organopolysiloxanes which both provide softness as well as hydrophilic character. All these patents and publications are herein incorporated by reference.

Quaternary ammonium compounds bearing hydrophobic groups have also been used as fabric softeners, for example fatty methyl ammonium salts. Examples are included in numerous patents and published applications, such as EP-A 0 040 562 and EP-A 0 239 910, herein incorporated by reference. Numerous quaternary ammonium compounds suitable as fabric softeners are available from Degussa under the trade name Rewoquat®, and include both fatty quaternary ammonium compounds and organopolysiloxane quaternary ammonium compounds. Solid inorganic softeners such as the smectite clays of U.S. Pat. No. 5,019,292 are not within the scope of the CD inclusion complexes of the invention, although these may be separately added to detergent formulations.

Defoamers are especially important in textile washing, as the generation of foam interferes with the washing process and also requires greater energy input for agitation. Many types of defoamers have been employed, and have long been used, as indicated by U.S. Pat. No. 1,947,725 (1934). Mineral or "white" oils and similar compounds such as oligomeric polyisobutylenes have been used as defoamers. However, organopolysiloxane compounds have proven to be most effective. Unfortunately, most of these compounds rapidly lose their effectiveness, and thus complex defoamer compositions such as those of U.S. Pat. Nos. 4,477,371 and 4,919,843, herein incorporated by reference, have been proposed.

A particular problem with respect to defoamers is their stability, not only in the wash or rinse liquor, but in the formulations containing them, which conventionally include numerous "harsh" alkalies and surfactants, as disclosed by U.S. Pat. No. 3,933,672, herein incorporated by reference. The '672 patent improves storage stability by forming microencapsulated defoamers. However, preparation of microencapsulated products is relatively expensive. U.S. Pat. No. 4,686,060 discloses use of separate "control prills" of fatty acid soap, quaternary ammonium salt, and silicone fluid. In U.S. Pat. No. 5,238,596, defoamers are prepared by melting together a silicone antifoam, a low-melting fatty acid or alcohol, and spraying onto starch granules in a fluidized bed coater.

Liquid detergent formulations provide more formidable challenges, since prilled or starch absorbed products, in the highly surfactant loaded and partially aqueous environment, are soluble or subject to loss of antifoam active. In addition, ingredients in liquid formulations, including softeners, must be resistant to sedimentation, or separation. Otherwise, a non-homogenous composition may be formed during storage. In U.S. Pat. No. 5,643,862, silicone-based defoamers are first blended with a water-free nonionic surfactant to which is then added to hydrophobic silica. Similar is U.S. Pat. No. 5,648,327. U.S. Pat. Nos. 4,686,060; 5,238,596; and 5,643,862 are herein incorporated by reference. Polyether and glycol-modified organopolysiloxanes have also proven useful as antifoams, as disclosed in U.S. Pat. Nos. 6,187,891 B1; 5,380,464; 5,625,024; 5,032,662, and European patent EP 0 663 225, all herein incorporated by reference.

Antiredeposition agents are disclosed in U.S. Pat. No. 4,659,497, herein incorporated by reference, as are also optical brighteners, i.e. TINOPAL CBS-X and TINOPAL ATS-X, both products of Ciba Specialities. Other antiredeposition agents and brighteners are well known.

By the term "hydrophobic active" is meant a hydrophobic substance which is present in laundering compositions in minor amount, i.e. less than 10% by weight and generally in considerably lesser amounts, e.g. from 0.01 to 2 weight percent, which have at least one hydrophobic portion such that the hydrophobic active may be successfully incorporated into a modified or unmodified CD to form an inclusion compound. The entire hydrophobic active need not be hydrophobic, and is generally not so constructed. In most cases, a hydrophobic portion will bear polar groups which may be ionic or hydrophilic. However, the presence of the hydrophobe allows inclusion complexes to be formed. These inclusion compounds have been found to be stable in the harsh environment of laundry compositions, and yet readily disperse in the aqueous wash environment, where controlled and/or delayed release of their hydrophobic actives occurs. Non-limiting examples of hydrophobic actives include softeners, optical brighteners, defoamers, and antistats. The inclusion complexes may be soluble, or may remain in the working strength laundry composition as a dispersion. The latter are particularly useful when the hydrophobic active is to be deposited onto the textile material. Surprisingly, the inclusion complexes function substantially independently of the type of water, i.e. purified, hard, soft, river, etc. This result is highly unexpected.

The cyclodextrins useful herein include all cyclodextrins, both modified and unmodified. Unmodified cyclodextrins include the most common α-, β-, and γ-cyclodextrins, prepared by enzymatic digestion of natural starches, predominantly corn starch. Modified CDs are also well known, including alkylated, hydroxyalkylated, esterified, and other forms of modification, such as incorporation of sodium butylsulfonate groups or by external branching to contain further saccharide moieties. The modified CDs frequently have higher water solubilities than their unmodified counterparts. Cyclodextrins of many types are commercially available from Wacker Biochem Corporation, Adrian, Mich.

Incorporation of the hydrophobic laundry composition actives may be accomplished by any suitable technique. For example, the active, if liquid, may be added to an aqueous composition containing dissolved and/or dispersed CD and agitated, or kneaded where appropriate. Both liquid and solid hydrophobic actives may also be dissolved in a suitable solvent and added to the aqueous cyclodextrin composition. The cyclodextrin inclusion complex may in some cases precipitate from solution, or may be isolated by drying, including, in particular, spray drying and freeze drying, the latter also including spray freeze drying. Suitable techniques are disclosed in U.S. Pat. Nos. 4,775,749; 4,777,162; 4,831,022; and 5,189,149, all incorporated herein by reference, and in various treatises, e.g. CYCLODEXTRIN TECHNOLOGY, J. Szejtli, Ed., Kluwer Academic Publishers, Dordrecht, NL, 1988; and COMPREHENSIVE SUPRA MOLECULAR CHEMISTRY, Vol. 3, Cyclodextrins, J. L. Attwood, et al., Ed. 5, Elsevier, Oxford, U.K., 1996.

Liquid hydrophobic actives may also be added directly to dry CD, and kneaded, although this procedure is not preferred. The mole ratio of hydrophobic active to CD is between 0.1:1 to 10:1, more preferably 0.2:1 to 5:1, and most preferably, 0.8:1 to 2:1. If the mole ratio is significantly greater than 2:1, there is a possibility that some hydrophobic active will be adsorbed or incorporated physically in other than an inclusion complex, and thus mole ratios of less than or equal to 2:1 are preferred. The hydrophobic active may be a single active or a combination of two or more actives of the same or different type. It has surprisingly been discovered that CD inclusion complexes containing multiple hydrophobic guests within a single cavity can be prepared.

Suitable laundering compositions are disclosed in the references cited previously. All contain surfactants and other additives. Preferred compositions are consumer (household) and industrial textile laundering compositions in liquid concentrates or as solid powders, granulates, prills, or bricks. Typical detergent powder formulations include:

| | A | B | C | D |
|---|---|---|---|---|
| Sodium tripolyphosphate | 50% | 50% | | |
| Zeolyte | | | 25% | 25% |
| Polycarboxylates | | | 4% | 4% |
| Organic phosphonates | 0.2% | 0.2% | 0.4% | 0.4% |
| Sodium silicate | 6% | 6% | 4% | 4% |
| Sodium carbonate | 5% | 5% | 15% | 15% |
| Surfactants | 12% | 12% | 15% | 15% |
| Sodium perborate | 14% | 14% | 18% | 18% |
| Activator | 2% | 2% | 2.5% | 2.5% |
| Sodium sulphate | 24% | 24% | 9% | 9% |
| Enzymes | 1% | 1% | 0.5% | 0.5% |
| Antiredeposition agents | 0.2% | 0.2% | 1% | 1% |
| Optical brighteners | 0.2% | | 0.2% | |
| Brightener Complex | | 0.5% | | 0.5% |
| Perfume | 1% | 1% | 0.2% | 0.2% |
| Water | | | 5% | 5% |

Examples of Compact Detergent Powder Formulations are:

| | E | F | G | H |
|---|---|---|---|---|
| Sodium tripolyphosphate | 50% | 50% | | |
| Zeolyte | | | 25% | 25% |
| Polycarboxylates | | | 5% | 5% |
| Organic phosphonates | | | 0.2% | 0.2% |
| Sodium silicate | 5% | 5% | 4% | 4% |
| Sodium carbonate | 4% | 4% | 15% | 15% |
| Surfactants | 14% | 14% | 15% | 15% |
| Sodium perborate | 10% | 10% | 13% | 13% |
| Activator | 3% | 3% | 5% | 5% |
| Sodium sulphate | 4% | 4% | 5% | 5% |
| Enzymes | 0.8% | 0.8% | 0.8% | 0.8% |
| Antiredeposition agents | 1% | 1% | 1% | 1% |
| Optical brighteners | 0.3% | | 0.3% | |
| Brightener Complex | | 1.0% | | 1.0% |
| Perfume | 0.2% | 0.2% | 0.2% | 0.2% |
| Water | 8% | 8% | 5% | 5% |

Having generally described this invention, a further understanding can be obtained by reference to certain specific examples which are provided herein for purposes of illustration only and are not intended to be limiting unless otherwise specified.

Preparation of Complexes

In the examples, Wetsoft™ is an alkylene oxide modified aminoalkyl-functional silicone, SM 6018 is a stearyl dimethicone, DMC 3071 VP is a dimethicone copolyol, and PDM 20 is a phenyl dimethicone fluid.

EXAMPLE 1

A 250 ml Erlenmeyer flask was charged with 5.0 g (4.4 mmole) dry Beta-cyclodextrin in 100 ml RO (purified by reverse osmosis) water. The mixture was magnetically stirred and heated to 70° C., then 3.6 g (1.0 eq., 86% pure) of Rewoquat® was added. The quat melted into the solution and a fine white precipitate formed almost immediately. The mixture was maintained at 70° C. overnight with stirring then allowed to cool to room temperature. The whole solution was freeze-dried.

A yield of 7.88 g (100%) was obtained of a fine white powder. Analysis (NMR) 35.6% Rewoquat, CD 1:0.90 Rewoquat.

EXAMPLE 2

A 3 L jacketed kettle was charged with 100 g (0.0881 mole) dry Beta-cyclodextrin in 1000 ml RO water. The mixture was mechanically stirred and heated to 70° C., then 72 g (1.0 eq., 86% pure) of Rewoquat was added. The Rewoquat melted into the solution and a fine white ppt. formed almost immediately. The mixture was maintained at 70° C. overnight with stirring. The mixture was allowed to cool to room temperature and was transferred to a drying tray to air-dry overnight. Additional drying was done under vacuum at 45° C. A yield of 162.34 g (100%) was obtained of a white powder. Analysis (NMR) 39.4% Rewoquat, CD 1:1.05 Rewoquat. $H_20$: 5.5%.

EXAMPLE 3

A 5 L jacketed kettle was charged with 350.0 g (0.308 mole) dry Beta-cyclodextrin in 3500 ml RO water. The mixture was mechanically stirred and heated to 70° C., then 251.9 g (1.0 eq., 86% pure) of Rewoquat was added. The Rewoquat melted into the solution and a fine white ppt. formed almost immediately. The mixture was maintained at 70° C. overnight with stirring. The resulting cream was allowed to cool and air-dry for 3 days then dried overnight under vacuum at 45° C.

A yield of 583 g (100%) was obtained of a white powder. Analysis (NMR)41.4% Rewoquat, CD 1:1.14 Rewoquat. DSC: 68° C., delta H=24.47 J/g. $H_2O$=6.3%

EXAMPLE 4

A 3 L Jacketed kettle was charged with 120.0 g (0.106 mole) dry Beta-cyclodextrin in 1200 ml of RO water. The mixture was mechanically stirred and heated at 70° C., then 43.2 g (0.5 eq., 86% pure) of Rewoquat was added. The resulting white foamy mixture was maintained at 70° C. for 3 days with stirring then allowed to cool to room temperature. The fine suspension was allowed to stand for 3 days in drying trays before the resulting paste was further dried under vacuum at 50° C. Upon drying, a yield of 156.0 g (99%) was obtained of a fine white solid.

Analysis (NMR) 22.4% Rewoquat, CD 1:0.47 Rewoquat. DSC: 72.1° C., delta H 8.29 J/g. $H_2O$=4.3%

EXAMPLE 5

A 3 L jacketed kettle was charged with 150.0 g (0.132 mole) dry Beta-cyclodextrin in 2200 ml RO water. The mixture was mechanically stirred and heated to 70° C., then 57 g (1.0 eq.) sorbitan monostearate was added. The material melted into the solution and a fine white ppt. formed almost immediately. The mixture was maintained at 70° C. overnight with stirring. The mixture was allowed to cool to room temp. before filtering. The solid was dried overnight under vacuum at 35° C. A yield of 180 g (82%) was obtained of a fine white powder. Analysis (NMR) 29.9% sorbitan monostearate, CD 1:1.12 guest. DSC: 53.35° C., delta H=15.522 J/g. $H_2O$=4.9%

EXAMPLE 6

A 3 L jacketed kettle was charged with 175.6 g (0.155 mole) of dry Beta-cyclodextrin and 2200 ml of RO water. The mixture was heated to 80° C. and mechanically stirred to dissolve the solid. Once the CD had dissolved, 63.3 g (0.95 eq.) of sorbitan monostearate was added. A white precipitate formed immediately and the cloudy mixture was maintained at 80° C. overnight with stirring. The mixture was allowed to cool to room temperature and the solid collected via filtration. Upon drying overnight under vacuum at 40° C., 217.2 g (90.8%) was obtained as a fine white powder. DSC indicated complete complexation. Analysis (NMR): 23.3% sorbitan monostearate; CD 1:0.8 sorbitan monostearate. $H_2O$: 5.9%.

EXAMPLE 7

A 3 L jacketed kettle was charged with 400 g (0.411 mole) of dry Alpha-cyclodextrin and 2000 ml of RO water. The mixture was heated to 80° C. and stirred mechanically to dissolve the CD. Once the CD had dissolved, 168.3 g (0.95 eq.) of sorbitan monostearate was added. A white precipitate formed immediately and the cloudy mixture was maintained at 80° C. overnight. The mixture was allowed to cool to room temperature and the solid collected via filtration. Upon drying overnight under vacuum at 40° C., 543.2 g (95.6%) was obtained as a fine white powder. Analysis (NMR):

24.6% sorbitan monostearate; CD 1:0.74 sorbitan monostearate. DSC: 56.8° C., delta H 5.013 J/g. $H_2O$: 4.1%.

EXAMPLE 8

A 2 L jacketed kettle was charged with 150.0 g (0.132 mole) dry Beta-cyclodextrin in 1300 ml RO water. The mixture was mechanically stirred and heated to 70° C., then 87.5 g (1.0 eq.) sorbitan distearate was added. The sorbitan distearate melted into the solution and a fine white ppt. formed almost immediately. The mixture was maintained at 70° C. for 3 days with stirring. The mixture was allowed to cool to room temp. before filtering. The solid was dried overnight under vacuum at 50° C. A yield of 234 g (98%) was obtained of a fine white powder.

Analysis (NMR) 39% sorbitan distearate, CD 1:1.04 sorbitan distearate. DSC: 63.1° C., delta H=4.206 J/g; 84.4° C., delta H=9.841 J/g. $H_2O$=5.9%

EXAMPLE 9

A 3 L jacketed kettle was charged with 200.0 g (0.176 mole) dry Beta-cyclodextrin in 2000 ml RO water. The mixture was mechanically stirred and heated to 70° C., then 58.97 g (0.48 eq.) sorbitan distearate was added. The sorbitan distearate melted into the solution and a fine white ppt. formed almost immediately. The mixture was maintained at 70° C. for 3 days with stirring. The mixture was allowed to cool to room temp. before filtering. The solid was dried overnight under vacuum at 50° C. A yield of 227.46 g (87.8%) was obtained of a fine white powder. Analysis (NMR) 26.4% sorbitan distearate, CD 1:0.58 sorbitan distearate. DSC: 54.03° C., delta H=13.080 J/g; 91.0° C., delta H=9.487 J/g. $H_2O$=6.8%

EXAMPLE 10

A 5 L jacketed kettle was charged with 400 g (0.352 mole) dry Beta-cyclodextrin in 3500 ml RO water. The mixture was mechanically stirred and heated to 70° C., then 322.6 g (0.95 eq.) sorbitan tristearate was added. The sorbitan tristearate melted into the solution and a fine white ppt. formed almost immediately. The mixture was maintained at 70° C. for 5 days with stirring. The mixture was allowed to cool to room temp. before filtering. The solid was dried overnight under vacuum. A yield of 676.3 g (94%) was obtained of a fine tan powder.

Analysis (NMR) 25.3% sorbitan tristearate, CD 1:0.40 sorbitan tristearate. DSC: 50.22° C., delta H=38.979 J/g (17.7% free), $H_2O$=4.5%

EXAMPLE 11

A 1 L beaker was charged with 220 ml RO water at 70° C., and 84.9 g (1.0 eq.) sorbitan tristearate. The solid melted into the solution as the mixture was homogenized. To the mixture was added 100.0 g (0.088 mole) dry Beta-cyclodextrin. The hot slurry was homogenized at high speed until thickening occurred after ~5 minutes. The creamy mixture was transferred to a drying tray and allowed to stand overnight. The gel was then dried overnight under vacuum at 40° C. A yield of 179.45 g (97%) was obtained of a fine white powder. Analysis (NMR) 46.3% sorbitan tristearate, CD 1:1.02 sorbitan tristearate. DSC: 48.7° C., delta H=24.987 J/g.

EXAMPLE 12

A Stephan UMC-5 mixer was charged with 468.7 g (0.413 mole) dry Beta-cyclodextrin and 750 ml of RO water. The mixture was heated at 65° C. as 395 g (1.0 eq.) of sorbitan tristearate was added. After 20 minutes, the mixture had thickened to form a paste, which was maintained at 65° C. with mixing for 4 hours. The product was transferred to a drying tray and allowed to cool overnight. The material was further dried under vacuum at 45° C. to give 886.5 g (100%) of a fine white powder. DSC: 51.68° C., delta H=41.859 J/g; $H_2O$: 3.9%.

EXAMPLE 13

A 5 L jacketed kettle was charged with 250 g of dry Beta-cyclodextrin and 2500 ml of RO water. The mixture was heated to 70° C. to dissolve the CD. To the solution was added 70.76 g (0.33 eq.) of sorbitan tristearate with mechanical stirring. A white precipitate formed as the sorbitan tristearate melted into solution. After 3 days of stirring, the mixture was allowed to cool to room temperature and filtered. The solid was dried under vacuum at 45° C. to give 249.82 g (78%) of a white powder. Analysis(NMR): 31.9% sorbitan tristearate; CD 1.0:0.55 sorbitan tristearate. $H_2O$: 5.6%. DSC indicated complete complexation.

EXAMPLE 14

A mortar was charged with 80.0 g (0.0705 mole) dry Beta-cyclodextrin and 150 ml RO water. The components were ground together to a fine paste then 39.8 g (1.0 eq.) of Tinopal® CBS-X (Ciba Specialities) was added with grinding. The paste thickened, additional water (50 ml) as was added and the grinding continued. The paste was left to stand with occasional mixing for 2 hrs. The yellow mixture was transferred to a drying tray and allowed to stand overnight. The material was then dried overnight under vacuum at 30° C. A yield of 131.47 g (100%) was obtained of a pale yellow solid. Analysis (NMR) 32.9% optical brightener, CD 1:0.98 CBS. $H_2O$=13.2%

EXAMPLE 15

A 10% w/v hydroxylpropyl β-cyclodextrin solution was prepared from 5.0 g dry CD in 50 ml of RO water. 1.5 g of CBS was added and the solution stirred magnetically overnight. In the morning the clear solution was freeze-dried. A yield of 6.22 g (96%) was obtained of a light yellow solid.

EXAMPLE 16

A 1 L plastic beaker was charged with 42.4 g of light mineral oil (Aldrich) and 250 ml of RO water. The mixture was homogenized for 2 minutes using a Silverson LRT4-A mixer then 200 g of dry Beta-cyclodextrin was added. The mixture was homogenized at 10,000 rpm until thickening occurred (about 5 min.). The resulting paste was transferred to a drying tray and allowed to stand overnight before additional drying under vacuum at 40° C. was done overnight. A yield of 252.4 g (100%) was obtained for the white solid. $H_2O$: 9.0%.

EXAMPLE 17

A Stephan UMC-5 mixer was charged with 400 g of dry Beta-cyclodextrin and 600 ml of RO water. The mixture was stirred to give a thin paste as 45 g of Wetsoft, an alkylene oxide-modified aminoalkyl-functional silicone, was added. After 2 minutes of mixing, the paste had thickened considerably so an additional 100 ml of water was added. After 4 hours of mixing, the paste was transferred to a drying tray and allowed to stand overnight. Additional drying was done under vacuum at 42° C. to give 494.84 g (100%) of a white solid. Analysis (NMR): 7.8% Wetsoft; CD 1:0.01 Wetsoft. $H_2O$: 12.6%.

EXAMPLE 18

A Stephan UMC-5 mixer was charged with 400 g of dry beta-cyclodextrin and 500 ml of RO water. Upon mixing, a thin paste was obtained to which 133 g of Silwet L7001, an alkylene oxide-modified silicone (OSi/Crompton Corp.) was added. The mixture immediately thickened and additional water (250 ml) was added. After 3 hours of mixing, the paste was transferred to a drying tray and allowed to stand overnight. Additional drying was done under vacuum at 45° C. for 24 hours. A yield of 554.35 g (100%) was obtained as a white powder. $H_2O$: 8–10%.

EXAMPLE 19

A 1 L kettle was charged with 170.0 g (0.15 mole) of Beta-cyclodextrin and 175 ml of RO water. The mixture was mechanically stirred at room temperature as 60.16 g (0.95 eq.) of squalane (Aldrich) was added. After 1 hour, the mixture had thickened such that stirring became impossible. The paste was allowed to stand at room temperature overnight before vacuum drying at 40° C. overnight. Yield: 219.47 g (95%). Analysis(NMR): 18.6% squalane; CD 1:0.62 squalane. $H_2O$: 8.6%.

EXAMPLE 20

A 10% w/v W7 HP solution was prepared from 5.0 g dry CD in 50 ml of RO water. To the solution was added 0.05 g of Tinopal AMS-GX and the mixture magnetically stirred overnight. The following morning the clear solution was freeze-dried. A yield of 4.93 g (98%) was obtained of a white solid.

EXAMPLE 21

A 1 L beaker was charged with 23.0 g (0.2 eq.) of DMC 6038, a dimethicone copolyol (Wacker) and 180 ml of 60° C. RO water. The mixture was homogenized via a Silverson L4RT-A mixer as 150 g (0.132 mole) of dry Beta-cyclodextrin was added. After 15 minutes, the mixture was poured into a drying tray and allowed to stand overnight. Additional drying was done under vacuum at 40° C. to give 175.21 g (100%) of a white powder. DSC indicated complete complexation.

EXAMPLE 22

A 1 L beaker was charged with 16.7 g SM 6018, a stearyl dimethicone (Wacker) and 100 ml of 60° C. RO water. The mixture was homogenized via a Silverson L4RT-A mixer as 150.0 g of dry Beta-cyclodextrin was added. After 15 minutes, the hot slurry was poured into a drying tray and allowed to stand overnight. Additional drying under vacuum at 40° C. gave 169.42 g (100%) of product. $H_2O$: 8.9%. DSC: 41.3° C., delta H=3.809 J/g

EXAMPLE 23

A 1 L beaker was charged with 30.0 g SM 6018, a stearyl dimethicone (Wacker) and 200 ml of 70° C. RO water. The mixture was homogenized via a Silverson L4RT-A mixer as 170.0 g of dry Beta-cyclodextrin was added. After 10 minutes of mixing at 7500 rpm, the hot mixture was poured into a drying tray and allowed to stand overnight. Additional drying under vacuum at 42° C. gave 213.43 g (100%) of product. $H_2O$: 11.7%. DSC: 41.9° C., delta H=6.438 J/g.

EXAMPLE 24

A 1 L beaker was charged with 16.7 g DMC 3071VP, a dimethicone polyol (Wacker) and 150 ml of RO water. The mixture was homogenized via a Silverson L4RT-A mixer as 150 g of dry Beta-cyclodextrin was added. After 10 minutes of mixing, the hot mixture was poured into a drying tray and allowed to stand overnight. Upon vacuum drying at 40° C. overnight, a yield of 163.86 g (98%) was obtained. $H_2O$: 5.9%.

EXAMPLE 25

A 1 L beaker was charged with 10.53 g DMC 3071VP, a dimethicone copolyol (Wacker) and 250 ml of RO water. The mixture was homogenized via a Silverson L4RT-A mixer as 200.0 g of dry Beta-cyclodextrin was added. After 5 minutes of mixing at 10,000 rpm, the mixture had formed a paste that could no longer be mixed. The product was poured into a drying tray and allowed to stand overnight. Upon vacuum drying at 40° C. overnight, a yield of 224.45 g (100%) was obtained. $H_2O$: 10.9%.

EXAMPLE 26

A Stephan UMC-5 mixer was charged with 350.0 g (0.308 mole) dry Beta-cyclodextrin and 400 ml of RO water. The mixture was stirred to give a fine paste as 182.3 g (1.0 eq.) of magnesium stearate (Aldrich) was added. As thickening occurred, an additional 300 ml of RO water was added to keep the paste fluid. After 4 hours of mixing, the paste was transferred to a drying tray and allowed to stand overnight. Additional drying under vacuum at 45° C. overnight gave 583.6 g (100%) of a fine white powder. $H_2O$: 12.0%. DSC indicated complete complexation.

EXAMPLE 27

A Stephan UMC-5 mixer was charged with 300.0 g (0.231 mole) dry Gamma-cyclodextrin and 200 ml of RO water. The mixture was stirred to give a thin paste as 86.7 g (~0.5 eq.) of PDM 20 (Wacker) was added. Thickening of the paste occurred within 20 minutes. After 3 hours, the paste was transferred to a drying tray and allowed to stand overnight. Additional drying was done under vacuum at 45° C. to give 406.1 g (100%) of a fine white powder. $H_2O$: 7.8%

EXAMPLE 28

A 20% weight/volume solution of hydroxypropyl β-cyclodextrin was prepared from 45 g dry cyclodextrin in 1982 ml RO water. 13 g of Tinopal CBS (Ciba Specialities) was added and the solution stirred magnetically. In the morning, a clear solution was observed, which was spray dried. A LabPlant SD-05 Spray Dryer was used, with the following settings: chamber size, small; spray geometry, top; temperature, 180° C.; air flow, maximum; nozzle, 0.5 mm; pressure, maximum; soln. feedrate, 10 ml/min; soln. concentration, 10% w/v CD. A yield of 36–5 g (63%) was obtained as a pale yellow solid.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. The words "a" and "an" mean one or more than one unless indicated otherwise.

What is claimed is:

1. A solid, particulate laundry detergent hydrophobic active composition, stable in the presence of other laundry detergent formulation ingredients, comprising at least one hydrophobic active as an inclusion complex in a cyclodextrin wherein said hydrophobic active is a softener comprising a nitrogen-group-containing organopolysiloxane, a nitrogen-free organopolysiloxane, a fatty quaternary ammonium compound, or a sorbitan ester.

* * * * *